US009624675B2

(12) United States Patent
Schaefer

(10) Patent No.: US 9,624,675 B2
(45) Date of Patent: Apr. 18, 2017

(54) METHOD AND DEVICE TO ATTACH BUILDING SIDING BOARDS

(71) Applicant: Fiber Cement Foam Systems Insulation, LLC, Manalapan, NJ (US)

(72) Inventor: Russ Schaefer, Manalapan, NJ (US)

(73) Assignee: Fiber Cement Foam Systems Insulation, LLC, Manalapan, NJ (US)

( * ) Notice: Subject to any disclaimer, the term of this patent is extended or adjusted under 35 U.S.C. 154(b) by 0 days.

(21) Appl. No.: 14/164,697

(22) Filed: Jan. 27, 2014

(65) Prior Publication Data

US 2014/0208679 A1 Jul. 31, 2014

Related U.S. Application Data

(60) Provisional application No. 61/790,385, filed on Mar. 15, 2013, provisional application No. 61/757,175, filed on Jan. 27, 2013.

(51) Int. Cl.

| | |
|---|---|
| ***E04F 13/07*** | (2006.01) |
| ***E04F 13/08*** | (2006.01) |
| ***E04F 13/28*** | (2006.01) |

(52) U.S. Cl.

CPC ..... *E04F 13/0832* (2013.01); *E04F 13/0837* (2013.01); *E04F 13/0864* (2013.01); *E04F 13/28* (2013.01)

(58) Field of Classification Search

CPC ..... E04F 13/0832; E04F 13/0837; E04F 13/0864; E04F 13/28

USPC ... 52/489.1, 489.2, 543, 547, 546, 549, 550, 52/552, 702, 704

See application file for complete search history.

(56) References Cited

U.S. PATENT DOCUMENTS

| | | | | | |
|---|---|---|---|---|---|
| 2,293,744 | A | * | 8/1942 | Miles et al. | 52/547 |
| 2,308,129 | A | | 1/1943 | Tummins | |
| 3,174,192 | A | | 3/1965 | Heebink | |
| 3,408,786 | A | | 11/1968 | Snyker | |
| 4,320,613 | A | * | 3/1982 | Kaufman | 52/521 |
| 4,424,655 | A | | 1/1984 | Trostle | |
| 4,435,933 | A | | 3/1984 | Krowl | |
| 4,435,938 | A | | 3/1984 | Rutkowski | |
| 5,150,555 | A | | 9/1992 | Wood | |
| 5,564,245 | A | * | 10/1996 | Rademacher | 52/520 |
| 5,575,127 | A | | 11/1996 | O'Neal | |
| 5,622,020 | A | | 4/1997 | Wood | |
| 5,799,446 | A | | 9/1998 | Tamlyn | |
| D451,787 | S | | 12/2001 | Taft | |

(Continued)

FOREIGN PATENT DOCUMENTS

| | | | |
|---|---|---|---|
| CA | 2686307 | A1 | 5/2010 |
| WO | 02081840 | A1 | 10/2002 |
| WO | 2008124527 | A1 | 10/2008 |

OTHER PUBLICATIONS

Apex Ultrex Siding System Flyer; www.apexsiding.com; retrieved from internet Sep. 30, 2013.

*Primary Examiner* — William Gilbert

(74) *Attorney, Agent, or Firm* — Gearhart Law LLC

(57) ABSTRACT

The invention relates to building materials, in particular to attachment of siding boards, such as composite boards, or fiber cement boards on building siding. A clip to securely attach the boards is disclosed. The clip may be used with our without a shaped foam insulation board. A method to use the clip is also disclosed. Various embodiments of the clip are provided.

9 Claims, 7 Drawing Sheets

(56) References Cited

U.S. PATENT DOCUMENTS

| | | | | |
|---|---|---|---|---|
| 6,351,921 | B1 | 3/2002 | Roberson | |
| 6,367,220 | B1 | 4/2002 | Krause et al. | |
| 6,725,618 | B2 * | 4/2004 | Albracht | 52/489.1 |
| 6,725,619 | B1 | 4/2004 | Barber | |
| 6,941,716 | B2 * | 9/2005 | Kottman | 52/489.1 |
| D530,191 | S | 10/2006 | Taylor | |
| 7,225,592 | B2 | 6/2007 | Davis | |
| 7,441,382 | B2 * | 10/2008 | Beck et al. | 52/543 |
| D600,543 | S | 9/2009 | Coles | |
| 7,581,364 | B2 | 9/2009 | Godby | |
| 8,015,755 | B2 | 9/2011 | Miller et al. | |
| 2004/0237443 | A1 | 12/2004 | Haley et al. | |
| 2006/0272258 | A1 | 12/2006 | Pollock | |
| 2007/0056238 | A1 | 3/2007 | Albracht | |
| 2007/0234674 | A1 | 10/2007 | Hadlum | |
| 2009/0007517 | A1 | 1/2009 | Swanson | |
| 2009/0064599 | A1 * | 3/2009 | Bennett | 52/60 |
| 2009/0084058 | A1 | 4/2009 | Cahill et al. | |
| 2010/0132295 | A1 | 6/2010 | Bootier et al. | |
| 2010/0251655 | A1 | 10/2010 | Monteer | |
| 2011/0192102 | A1 | 8/2011 | Cottier et al. | |
| 2012/0317909 | A1 | 12/2012 | MacKenzie | |

* cited by examiner

METHOD AND DEVICE TO ATTACH BUILDING SIDING BOARDS

PRIORITY

This application claims priority of U.S. provisional applications Nos. 61/757,175 and 61/790,385 filed on Jan. 27, 2013 and on Mar. 15, 2013, respectively. The contents of both of these applications are incorporated herein in their entirety by reference.

FIELD OF THE INVENTION

The invention relates to building materials, in particular to attachment of building siding boards on building surfaces.

BACKGROUND OF THE INVENTION

The present invention relates to building materials in particular to attachment of building siding boards on building surfaces. The invention may be used with any kind of building siding materials, such as wood, composite, PVC, fiber cement or plastic. Especially the invention is suitable for attaching fiber cement or composite boards, but the invention may be used with other siding materials also. The invention may also be used with siding boards where a shaped foam insulation board is used under the siding and even with siding boards where the insulation foam is prefixed behind the boards.

The selection of building siding materials today is vast. The siding may be wood, vinyl, plastic, composite, fiber cement or other materials. It is customary to attach siding boards on the building surface by nailing or stapling. Fiber cement laps are usually nailed with galvanized nails. Nailing creates problems when the insulation foam under the board is thick because then the nailing may not provide enough support. Under strong winds the wind may get under the boarding and tear the boards off. As several boards are usually attached to one large insulation board, wind tear may destroy a large part of the building siding when the insulation board becomes even partially damaged.

There are various publications disclosing clips and mounting devices mainly for vinyl and wood siding panels.

U.S. Pat. No. 4,435,933 discloses a clip attached to the upper side of vinyl siding on the building structure.

U.S. Pat. No. 5,150,555 discloses another clip to attach upper side of a vinyl siding.

US Patent Application Number 2007/0056238 discloses a siding attachment strip containing a hook portion attached to an elongated strip element.

US Patent Application Number 2009/0007517 discloses a clip to attach the uppermost siding board.

US Patent Application Number 2010/0132295 discloses a clip for attaching vinyl sidings.

US Patent Application 2010/0251655 discloses a U-shaped clip for wood sidings.

U.S. Pat. No. 3,408,786 discloses U-shaped clip containing cushioning material adapted for mounting the upper edge of a siding member.

U.S. Pat. No. 2,308,129 discloses a Z-shaped clip for attaching shingles.

US Patent Application 2006/0272258 discloses a breakaway plastic clip to align lap siding during installation.

The flaw with the currently available attachment methods is that during high winds, storms and hurricanes the siding laps may become detached and great damage to the building structure may result. Furthermore, there are currently no methods or means available to apply for more secure attachment of siding boards; and specifically so when a shaped insulation board is used beneath the siding boards. The shaped insulation board is disclosed in U.S. application Ser. No. 13/029,336 and Ser. No. 13/450,165, both of which are incorporated in their entirety herein by reference.

The instant invention provides a solution to this and other problems arising from the currently used practices. The instant invention may be used with or without an insulation board and with any kind of siding boards.

SUMMARY OF THE INVENTION

It is an object of this invention to provide a method and means to improve wind and storm resistance of building siding.

It is another object of this invention to provide an economic way to attach siding boards durably on a building surface.

It is yet an object of this invention to provide a clip to attach fiber cement or composite siding boards on building surface.

It is still another object of this invention to provide a clip to attach siding boards on building surface where an insulation board is beneath the siding boards.

It is still another object of this invention to provide a clip to attach siding boards on building surface where a shaped insulation board is beneath the siding boards.

It is a further object of this invention to provide a clip to attach siding boards on building surface where insulation foam is prefixed on the back side of the siding board.

It is yet another object of this invention to provide a clip to attach siding boards on a building surface where an insulation board is beneath the siding and where the clip is also serving as a flashing element protecting the seam between two abutting siding boards, or protecting the seam between two abutting insulation foam boards from water penetration.

It is a further object of this invention to provide a clip to attach siding boards on building surface and simultaneously to provide means to align the siding board horizontally.

It is an object of this invention to provide a clip for attaching a siding board on a building surface, said clip comprising: a hind prong being substantially rectangular in shape and having a lower end, an upper end, and at last one attachment hole; a front prong being substantially rectangular in shape and having a lower end, an upper end, and at least one attachment hole; a horizontal portion having a front end and a back end, said front end being connected to the upper end of the front prong in a substantially rectangular angle, and said back end being connected to the upper end of the hind prong in a substantially rectangular angle; said horizontal portion having a width substantially equal to thickness of a siding board; said front prong, hind prong and horizontal portion forming a U-shaped fork where an upper end of the siding board snugly fits; and a vertical portion being substantially rectangular and having a lower end, an upper end, and at least one attachment hole, said vertical portion continuing seamlessly upward from the upper end of the hind prong.

It is an object of this invention to provide a clip for attaching a fiber cement board on a building surface, said clip comprising: a hind prong being substantially rectangular in shape and having a lower end, an upper end, and at last one attachment hole; a front prong being substantially rectangular in shape and having a lower end, an upper end, and at least one attachment hole; a horizontal portion having a front end and a back end, said front end being connected to the upper end of the front prong in a substantially rectangular angle, and said back end being connected to the upper end of the hind prong in a substantially rectangular angle; said horizontal portion having a width substantially equal to thickness of a siding board; said front prong, hind prong and horizontal portion forming a U-shaped fork where an upper end of the siding board snugly fits; and wherein a snap-away lip is attached to the lower end of the front prong or to the lower end of the hind prong.

It is yet another object of this invention to provide a clip for attaching a siding board on a building surface, said clip comprising: a hind prong being substantially rectangular in shape and having a lower end, an upper end, and at last one attachment hole; a front prong being substantially rectangular in shape and having a lower end, an upper end, and at least one attachment hole; a horizontal portion having a front end and a back end, said front end being connected to the upper end of the front prong in a substantially rectangular angle, and said back end being connected to the upper end of the hind prong in a substantially rectangular angle; said horizontal portion having a width substantially equal to the thickness of a siding board; said front prong, hind prong and horizontal portion forming a U-shaped fork where an upper end of the siding board snugly fits; a vertical portion being substantially rectangular and having a lower end, an upper end, and at least one attachment hole; said vertical portion continuing seamlessly upward from the upper end of the hind prong; and said front prong further having a cut out hook carved out of the front prong thereby leaving an opening in the front prong and said cut out hook being capable of being punched through the opening and penetrating through the siding board to the wall thereby attaching the board on the wall.

Still another object of the invention is to provide a method of attaching siding boards to a building surface, said method comprising the steps of: a) aligning at least two shaped insulating boards to a required orientation, said shaped insulating boards having a rectangular, substantially flat back surface and a substantially saw-tooth shaped cross-section thereby creating a plurality of substantially flat faced, protruding ridges on a front surface of said shaped insulating boards, adjacent ridges having a short face of one ridge joined in an angle to a long face of another ridge; and where, in said required orientation, said protruding ridges align in a desired orientation of said length of the siding board; and where the at least two shaped insulating boards are adjacent to each other vertically or horizontally and leaving a gap between said shaped insulating boards; b) providing multitude of siding boards and a multitude of clips of claim 1, said siding boards having a front face, a back face, an upper end, a lower end, two distal ends and having a thickness such that the upper end snugly fits into the fork of the clip; c) inserting the fork of the clip over an upper end of the siding board in such a away that the front face of the board faces the hind prong of the clip; d) inserting the siding board on the shaped insulation board by lining front prong toward a long face of a first ridge on the insulation board, the horizontal portion along the short face of the ridge and the vertical portion along a long face of a second ridge adjacent and above the first ridge; e) attaching the siding board in place by nailing through the attachment holes of the hind prong and the front prong, and securing the clip by nailing or screwing through the attachment holes of the vertical portion; f) repeating step c) with a second fiber cement board and a second clip; g) inserting the second fiber cement board on the shaped insulation board by lining the front prong toward a long face of the second ridge on the insulation, the horizontal portion along the short face of the second ridge and the vertical portion along a long face of an adjacent ridge above the second ridge; h) repeating step e); and i) repeating steps c to e until the building surface is sided with the multitude of the boards.

An object of the invention is to provide a method of attaching siding boards to a building surface, said method comprising the steps of: a) providing multitude of siding boards and a multitude of clips of claim 1, said siding boards having a front face, a back face, an upper end, a lower end, two distal ends and having a thickness such that the upper end snugly fits into the fork of the clip; b) inserting the fork of the clip over an upper end of the siding board in such a away that the back face of the siding board faces the front prong of the clip; c) attaching the siding board on the building surface by nailing or screwing through the attachment holes through the hind prong and the front prong, and securing the clip by nailing or screwing through the attachment holes on the vertical portion; d) repeating step b) with a second siding board and a second clip; e) attaching the second siding board vertically above the first siding board in such a way that the lower end of the second board covers fully the front prong of the clip and nailing or screwing the second siding board on the building surface through the attachment holes of hind prong and of the front prong, and securing the clip by nailing or screwing through the attachment holes of the vertical portion; and f) repeating steps c) to e) until the building surface is sided with the multitude of the boards.

BRIEF DESCRIPTION OF THE DRAWINGS

FIG. 1 B also illustrates an embodiment where a snap away lip is attached to the lower end of the front prong.

FIGS. 7 A, B and C illustrate a clip with a cutout hook.

DESCRIPTION OF THE PREFERRED EMBODIMENTS

Figure 1A:
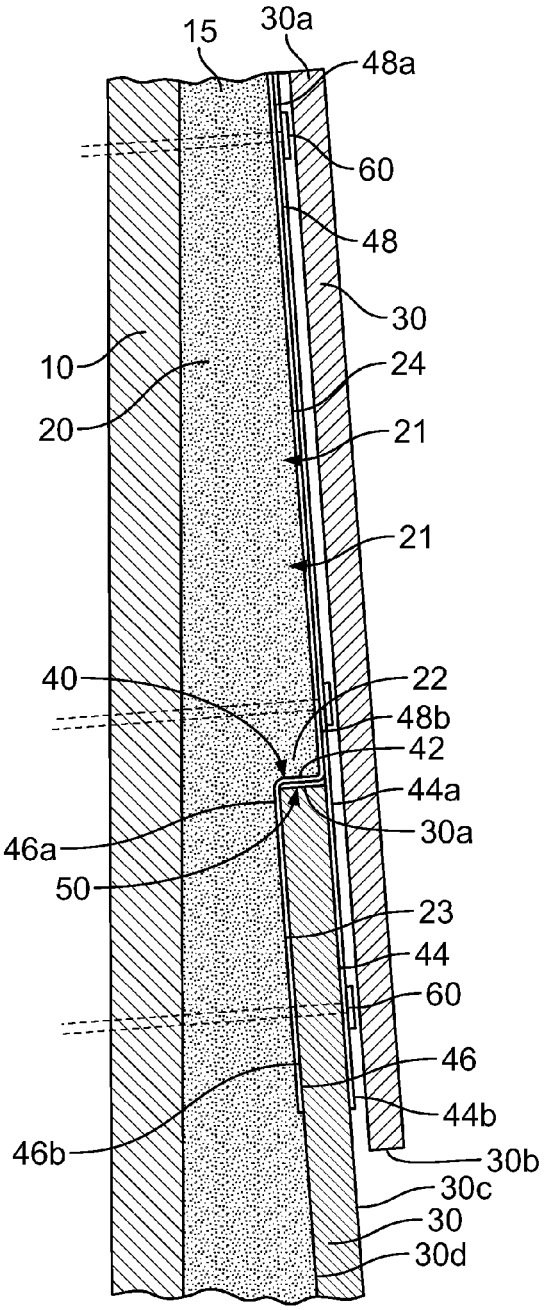
FIG. 1A is a vertical cross section showing a stud, a shaped insulation foam board with saw tooth like cross section, three vertically abutting siding boards, a clip having a fork and a vertical portion, wherein the fork holds the upper end of a siding board and the vertical portion elongates upward from the fork and forms flashing. The siding board is aligned along the ridges of the insulation foam board. A ridge has a short face and a long face and the fork of a clip holding the upper end of the siding board is inserted toward the ridge and the vertical portion is aligned on long face on an adjacent ridge above. The board is nailed or screwed onto the studs through attachment hole in the fork. The vertical portion of the clip forms a flashing between the upper siding board and the insulation board and the vertical portion is attached to the stud with nails or screws as well.

The preferred embodiments of the present invention will now be described with reference to FIGS. 1-5 of the drawings. Identical elements in the various figures are identified with the same reference numerals.

FIG. 1A is a vertical cross section showing a stud 10, shaped insulation foam board 20 with saw tooth like cross section 15. The shaped insulation board has ridges with short face 22 and long face 23. Two vertically abutting fiber cement boards 30, and a clip 40. The siding board 30 has an upper end 30*a*, a lower end 30*b*, a front side 30*c*, a back side 30*d*, and two distal ends (not shown in FIG. 1A). The clip 40 has a horizontal portion 42, a hind prong 44, a front prong 46, and a vertical element 48. The front prong 46 has an upper end 46*a*, and a lower end 46*b*. The hind prong has an upper end 44*a* and a lower end 44*b*. The horizontal portion 42 has a front end 42*a* and a back end 42*b*. The vertical portion 48 has an upper end 48*a* and a lower end 48*b*. The upper end of the hind prong 44*a* is attached to the back end of the horizontal portion 42*b* and the upper end of the front prong 46*a* is attached to the front end of the horizontal portion 42*a* to form an essentially U-shaped fork 50. The lower end of the vertical element 48*b* is attached to the upper end of the hind prong 44*a* thereby forming an elongated continuation of the hind prong. The siding boards 30 are inserted into the U-shaped forks 50. The clip 40 is so attached that the hind prong 44 and the vertical element 48 face the siding board 30 while the front prong 42 faces the insulation board 20. The foam board may have stud markings 21 showing location of the stud. The stud marking may be a vertical groove having a width similar to the width of the clip or it may be dots or other indicia. The siding boards 30 are attached to the stud 10 by nailing with nails, with screws or with equivalent 60 through the hind prong 44 and the front prong 46 and through the foam board 20. The clip 40 is also attached to the stud by nailing, screwing or otherwise through the vertical portion 48.

Figure 1B:
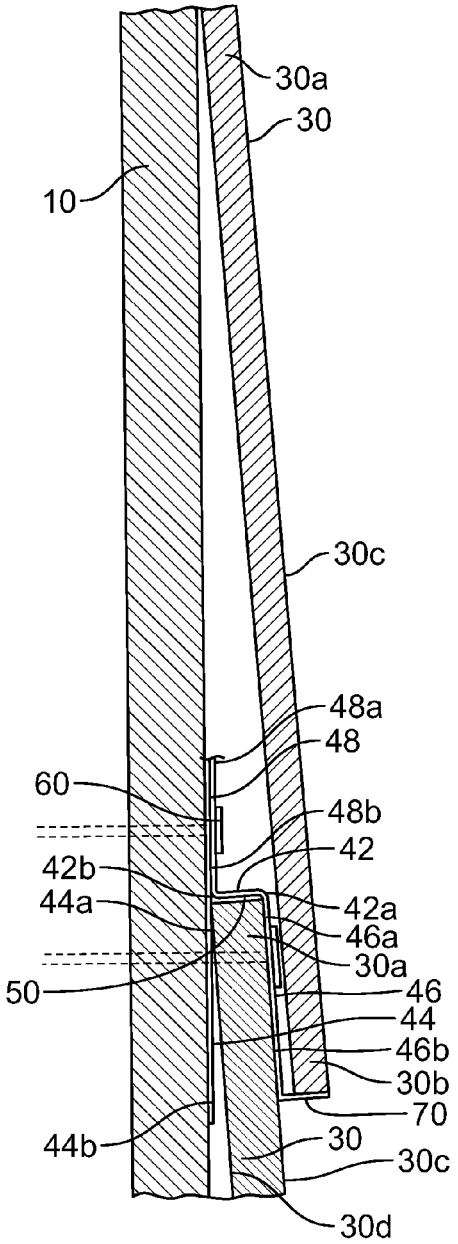
FIG. 1 B is a vertical cross section showing a stud, two vertically abutting siding boards, and a clip where the fork of the clip holds the upper end of a siding board and a the vertical portion elongates upward from the fork. The board is attached onto the studs through the attachment holes in the fork with nails or screws. The vertical portion is also attached with screws or nails. The vertical portion in this embodiment does not necessarily form a flashing but a separate flashing may be provided.

FIG. 1 B is a vertical cross section showing a stud 10, two vertically abutting siding boards 30, and a clip 40. The siding board 30 has an upper end 30*a*, a lower end 30*b*, a front side 30*c*, a back side 30*d*, and two distal ends (not shown in FIG. 1B). The clip 40 has a horizontal portion 42, a hind prong 44, a front prong 46, and a vertical element 48. The front prong 46 has an upper end 46*a*, and a lower end 46*b*. The hind prong has an upper end 44*a* and a lower end 44*b*. The horizontal portion 42 has a front end 42*a* and a back end 42*b*. The vertical portion 48 has an upper end 48*a* and a lower end 48*b*. The upper end of the hind prong 44*a* is attached to the back end of the horizontal portion 42*b* and the upper end of the front prong 46*a* is attached to the front end of the horizontal portion 42*a* to form an essentially U-shaped fork 50. The lower end of the vertical element 48*b* is attached to the upper end of the hind prong 44*a* thereby forming an elongated continuation of the hind prong. The siding board 30 is inserted into the U-shaped fork 50. The clips are so attached that the hind prong 44 and the vertical element 48 face the stud 10 and the front prong faces the siding board 30. The siding board is attached to the stud 10 by nailing with nails, with screws or equivalent 60 through the hind prong 44 and the front prong 46. The figure illustrates also a snap away lip 70 which may be a simple horizontal lip as shown in this figure or it may form a U-shaped cross section with the prong it is attached to.

Figure 2A:
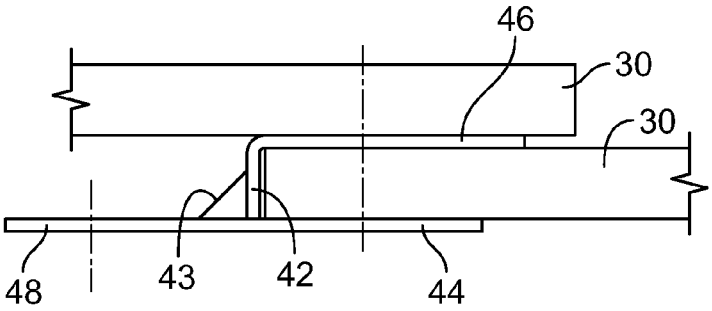
FIG. 2A-H illustrates vertical cross sections of various embodiments of the clip.

FIG. 2A-H illustrates various embodiments of the clip attached to a siding board 30. In FIG. 2A a welded z-piece is shown. The clip has a front prong 46, a horizontal portion 42 and a hind prong 44 which continues as vertical element 48. The vertical element 48 and the horizontal portion 42 are secured together with a securing portion 43.

Figure 2B:
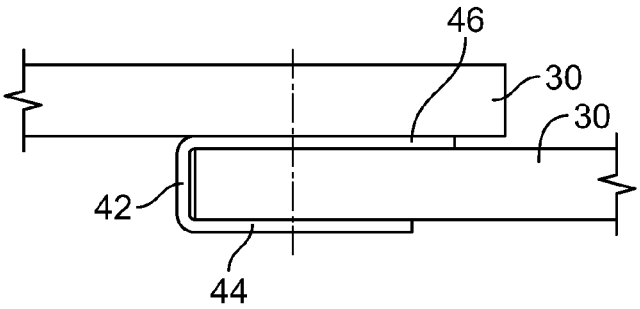

In FIG. 2B a U-shaped clip is shown. The clip has a front prong 46 and a hind prong 44 and a horizontal portion 42 in between them.

Figure 2C:
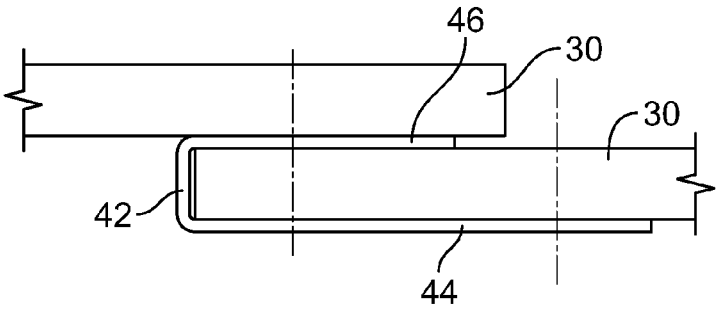

In FIG. 2C an extended U-shape clip is shown. The clip has a front prong 46 and a hind prong 44 and a horizontal portion 42 in between them. The front prong 46 is substantially shorter than the hind prong 44.

Figure 2D:
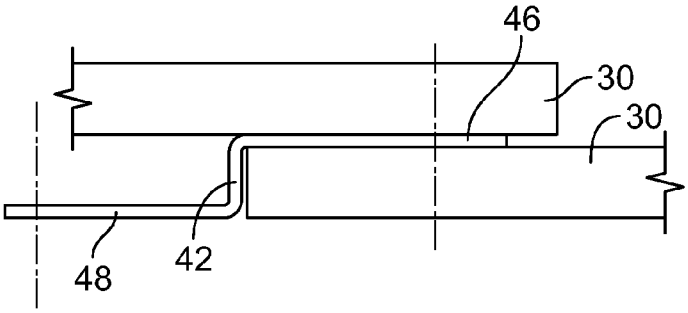

In FIG. 2D a 90 degree's Z-shape clip is shown. The clip is made of one piece having a front prong 46, a horizontal portion 42 and a vertical portion 48. The horizontal portion is attached to the prongs with a 90 degrees angle.

Figure 2E:
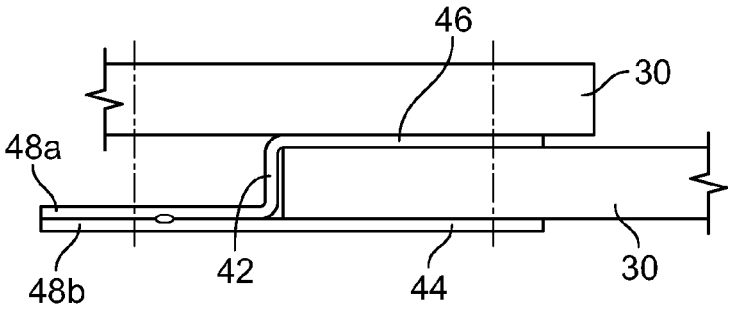

FIG. 2E shows a clip formed of two parts and welded together. One part of the clip includes a front prong 46, a horizontal portion 42 and a front vertical portion 48*a*. The second part includes a hind prong 44 and a hind vertical portion 48*b*. The front vertical portion and the hind vertical portions are equal of their lengths and are welded together.

Figure 2F:
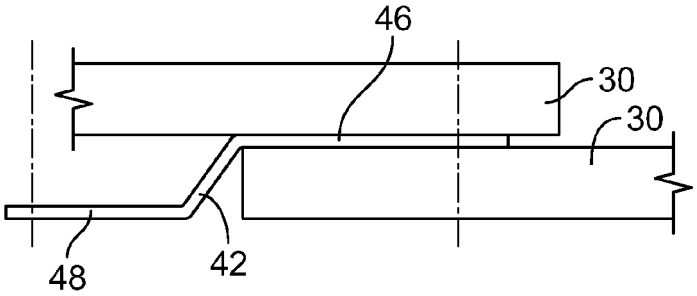

FIG. 2F show 45 degree's Z-shape clip. The clip is made of one piece having a front prong 46, a horizontal portion 42 and a vertical portion 48. The horizontal portion is attached to the prongs with a 45 degrees angle.

Figure 2G:
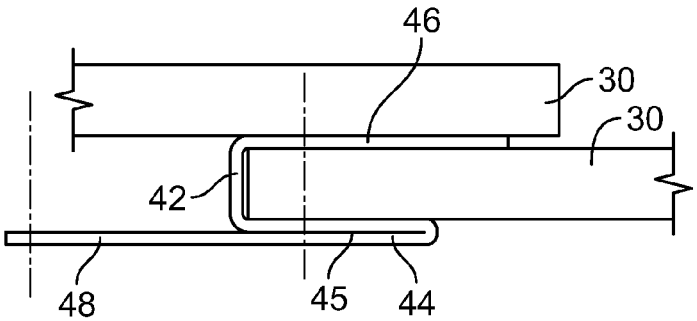

FIG. 2G shows a double layer h-shape clip with inside hem. The clip is formed of one piece and it contains a front prong 46, a horizontal portion 42, a hind prong 44 which includes a hem 45 and a vertical portion 48.

Figure 2H:
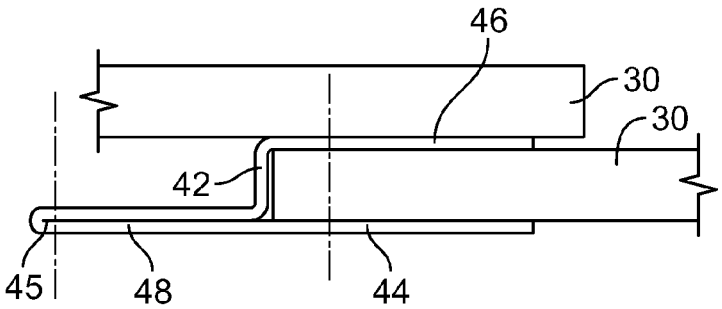

FIG. 2H shows a double layer h-shape clip with outside hem. The clip is formed of one piece and it contains a front prong 46, a horizontal portion 42, a hind prong 44 and a vertical portion 48 which includes a hem 45.

It is to be noted that even if in FIGS. 2A-2H the clip is illustrated so that is only encloses the siding board, it is possible to use the same clip in such dimensions that the horizontal portion would be allow a siding board with fixed insulation either to fit into the fork of the clip (FIGS. 2A, B, C, E, G and H) or to the angle between the front prong and the horizontal portion (FIGS. 2D and F) would allow the clip to be used with siding board with fixed insulation.

Figure 3:
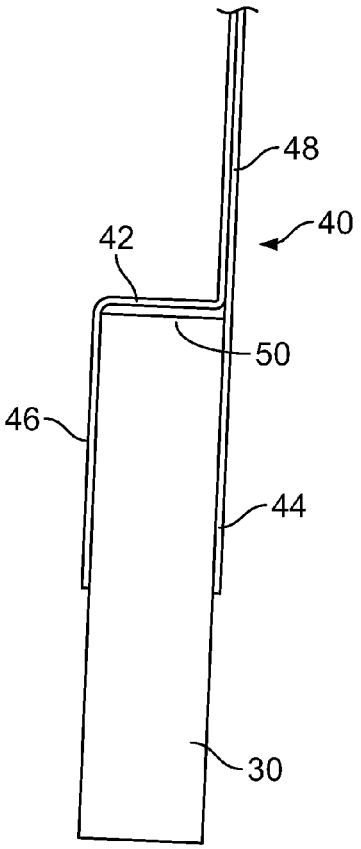
FIG. 3 illustrates a vertical cross section of a clip with a siding board attached in between of the fork of the clip.

FIG. 3 shows a vertical cross section of a clip 40 according to one preferred embodiment. The clip has a front prong 46, a horizontal portion 42 connecting the front prong 46 and the hind prong 44, and a vertical prong 48 extending from the hind prong. A siding board 30 is inserted into the fork 50 formed by the two prongs and the horizontal portion.

Figure 4A:
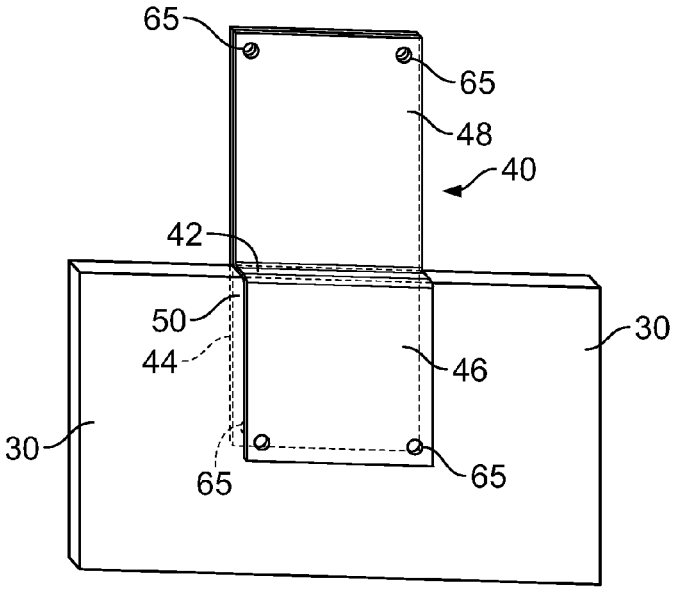
FIG. 4A illustrates a front view of a siding board attached in between of the fork of the clip.

FIG. 4A illustrates a front view of a siding board 30 attached in between the fork 50 of the clip 40. The clip has a front prong 46, a hind prong 44 and a horizontal portion 42. The figure shows attachment holes 65 for nails or screws to attach the vertical portion 48 onto the building. The figure also shows attachment holes 65 for nails or screws in the front prong 46 and in the hind prong 44 to attach the siding board 30 on the building.

Figure 4B:
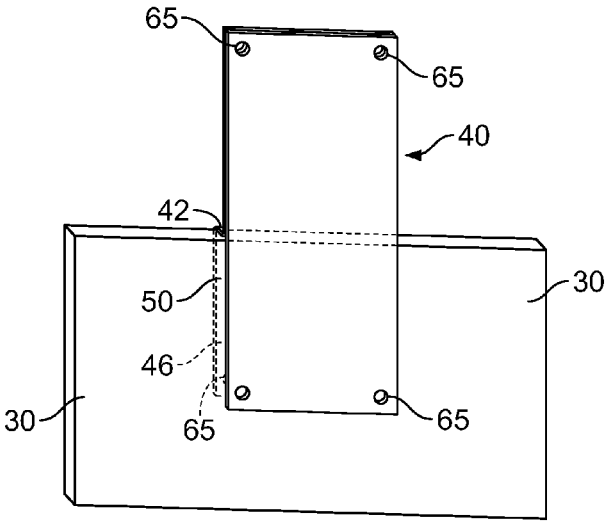
FIG. 4B illustrates a back view of a siding board attached in between of the fork of the clip.

FIG. 4B illustrates a back view of a siding board 30 attached in the fork 50 of the clip 40. The clip has a front prong 46, a hind prong 44 and a horizontal portion 42. The figure shows attachment holes 65 for nails or screws to attach the vertical portion 48 onto the building. The figure also shows attachment holes 65 for nails or screws in the front prong 46 and in the hind prong 44 to attach the siding board 30 on the building.

It is to be noted that even if in FIGS. 4A and 4B the attachment holes have been shown and round holes, they may also be horizontally extending narrow slits, which would allow the clip to move horizontally.

Figure 5:
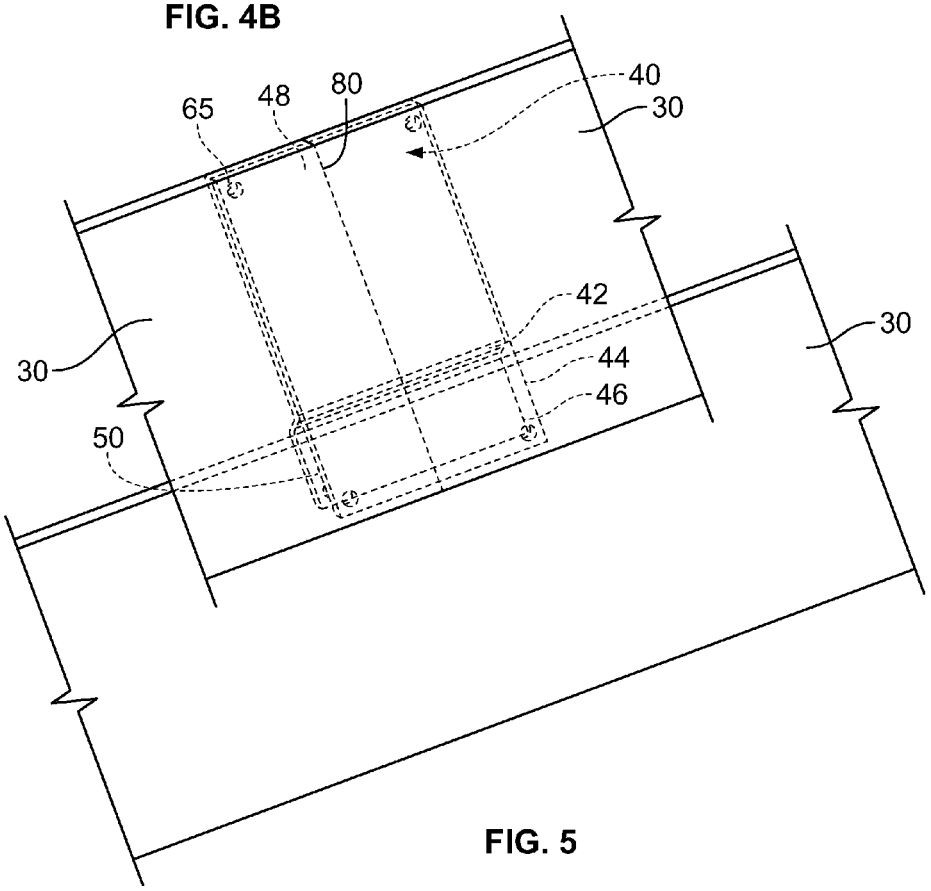
FIG. 5 illustrates a front view of a clip where the vertical portion of the clip forms a flashing for the seam between two abutting siding boards attached above the siding board that is attached between the fork.

FIG. 5 illustrates a front view of a siding board 30 attached in between of the fork 50 of the clip 40. The horizontal portion 42 has a depth that is substantially same as the thickness of the siding board. A second siding board 30 is attached above the first one and the siding boards are overlapping in a manner that the clip 40 remains invisible. This is possible because the lengths of the front prong 46 and the hind prong 44 are not greater than the area where the two fiber cement boards overlap. The vertical portion 48 forms a flashing over a gap 80 between to abutting siding boards.

Figure 6A:
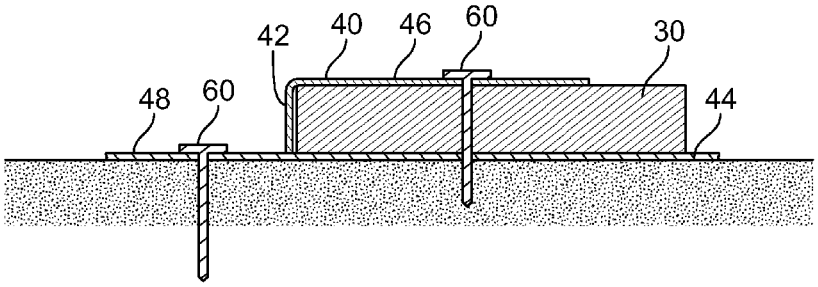
FIGS. 6A and 6B illustrate clips where the back prong is substantially of same length as the width of the siding board.
Figure 6B:
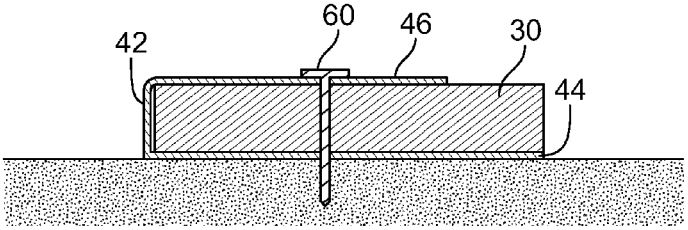

FIGS. 6A and 6B illustrate clips 40 where the hind prong 44 is substantially the same length as the width of the siding board 30.

Figure 6C:
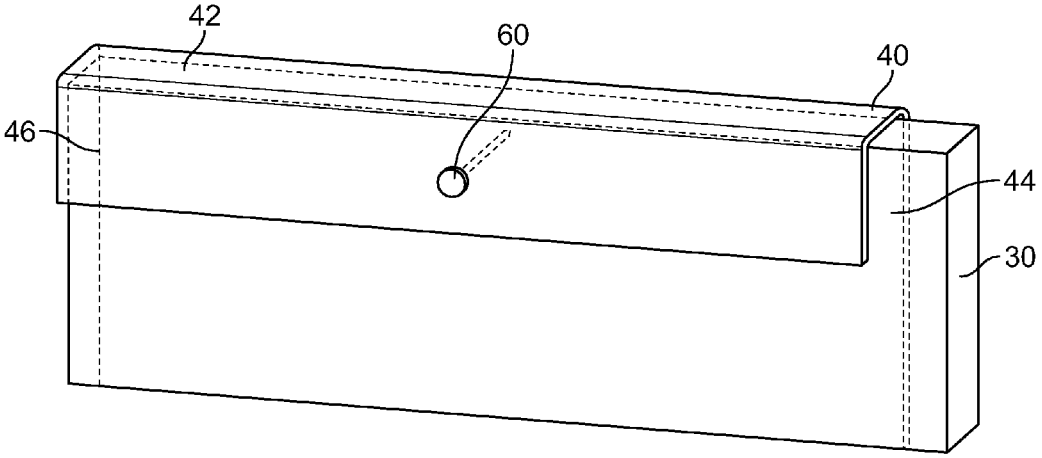
FIG. 6C illustrates a U-shaped clip comparable to clip in FIG. 2B. However this clip is substantially the same length as a siding board and can be used for one board or it can be used for covering the back of half a length of one board and half a length of adjacent board as is shown in FIG. 6C.

FIG. 6C illustrates an U-shaped clip 40 comparable to clip in FIG. 2B. However this clip is substantially the same length as a siding board 30 and thereby can be used for one board or it can be used for covering the back of half a length of one board and half a length of an adjacent board as is shown in FIG. 6C.

Figure 7A:
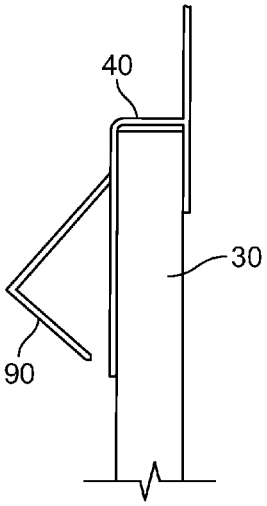
In FIG. 7A the hook is in open position, and the siding board is in between the clip prongs.
Figure 7B:
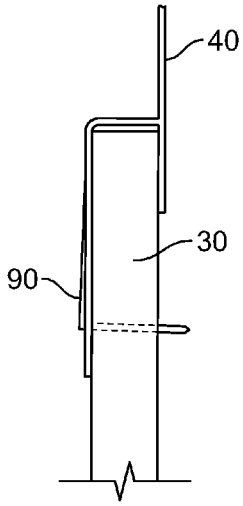
In FIG. 7B the hook has been pushed in, whereby the hook goes through the siding board and attaches the board on the wall structure behind the clip.
Figure 7C:
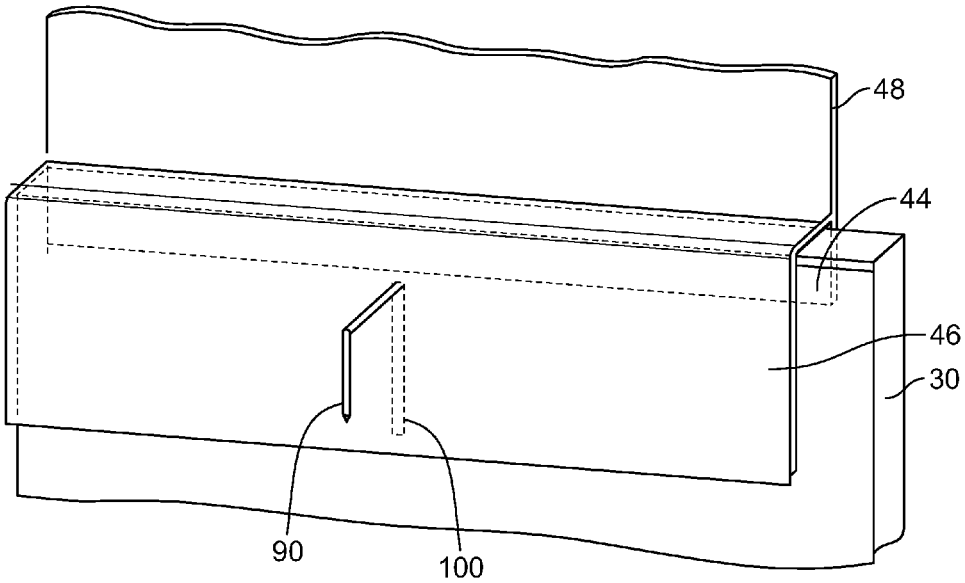
FIG. 7C shows a front perspective view of the clip with the cutout hook in open position. The hook is cut out from the clip leaving an opening in the clip. Once the hook is pushed close it goes through the opening and penetrates through the siding board and attaches it on the wall structure. The form of the clip is shown as H-shaped clip, but other clip designs described in this applications may also be used with the cutout hook.

FIGS. 7 A, B and C illustrate a clip 40 with a cutout hook 90. In FIG. 7A the hook 90 is in open position, and the siding board 30 is in between the clip prongs. In FIG. 7B the hook has been pushed in, whereby the hook goes through the siding board and attached the board on the wall structure behind the clip. FIG. 7C shows a front perspective view of the clip with the cutout hook in an open position. The hook is cut out from the clip leaving an opening 100 in the clip. Once the hook is pushed closed it goes through the opening and penetrates through the siding board 30 and attaches it on the wall structure. The form of the clip is shown as an H-shaped clip, but other clip designs described in this application may also be used with the cutout hook.

DETAILED DESCRIPTION OF THE INVENTION

Referring now to FIGS. 1-7, the invention is now described in details.

Referring now to FIGS. 1 A and B, a preferred embodiment of this invention provides a clip and a method to use the clip for attaching a siding board securely on a building surface either with or without a shaped insulation foam board in between the building surface and the siding boards.

As is shown in FIG. 1A, the clip 40 has a horizontal portion 42, a hind prong 46, a front prong 44 and a vertical element 48. Figure illustrates the use of the clip 40 to attach siding boards 30 on to building surface where a shaped insulation board 20 is used in between of the building surface and the siding boards. The insulation board has a saw tooth like cross section 15 and ridges on its front side formed of short face 22 and adjacent long face 23, 24. The front prong 44, the horizontal portion 42 and the hind prong 46 of the clip form a U-shaped fork 50 into which an upper end of a siding board 30*a* is attached. The width of the fork is defined by the horizontal portion 42 and is such that an upper edge of the siding board snugly fits into the fork. The siding board in this case is inserted into the fork so that the front face of the board 30*c* faces the hind prong 44 of the clip. The back face of the board 30*d* faces the front prong 46 of the clip. The width of the horizontal portion 42 is substantially equivalent with short face of the ridge of the shaped insulation board 22 and thereby the siding board that is attached in the fork will be aligned on the insulation board so that the horizontal portion 42 of the clip is against a short face of ridge 22 of the insulation board and the front prong 46 is against a long face of a first ridge 23 of the insulation board. The vertical portion 48 of the clip is aligned with a long face of second ridge 24 above the first ridge. The siding board 30 that is within the fork 50 is attached to the building surface by nailing or screwing through the insulation board to a stud 10. A nail or a screw 60 is inserted through the attachment holes in the hind prong 44, and the front prong 46. The clip is further attached from the vertical portion 40 with at least one nail or screw 60 thorough the insulation board 20 to the stud 10; preferably the vertical portion is attached with one or two nails or screws. According to one preferred embodiment the attachment of the board through the clip is conducted with screws. Optionally in this case also bolts may be used to strengthen the structure and to hold the siding board tightly in between the prongs of the fork.

According to one preferred embodiment the vertical portion 48 is substantially longer than the front prong 46. The vertical portion 48 preferably functions as a flashing element and therefore the length of the vertical portion is preferably substantially similar to the width of the long face of a ridge 24 of the shaped insulation board. According to one preferred embodiment the vertical portion is shorter than the long face of a ridge 23 of the shaped insulation board. According to one preferred embodiment the length of a vertical portion 48 and a front prong 46 together is same as the width of the long face of a ridge 24 of the shaped insulation board, which would allow the vertical portion of a clip to be used for attaching one siding board and the front prong of another clip used for attaching a siding board above the previous one to cover the width of the long face 24 of a ridge of the shaped insulation board. By this way, clips may be attached vertically on same line and the vertical portion of one clip and the front prong of the second clip form a complete flashing to cover either the abutting seam between two siding boards or to cover the gap between two vertically abutting insulation boards.

According to one preferred embodiment the shaped foam insulation board has stud markings indicating the location of the studs. The stud markings may be formed of a vertical flat groove that is to be lined along a stud. The vertical flat area may be about 4 inches wide but it may be wider or narrower depending on the width of the clips used. According to this embodiment the clip 40 would be inserted into the flat groove. In this case the clip may be inserted on the upper end of a siding board in such a way that the front side of the siding board faces the front prong and the back side of the siding board faces the hind prong.

As is shown in FIG. 1B, the clip 40 has a horizontal portion 42, a hind prong 46, a front prong 44 and a vertical element 48. Figure illustrates the use of the clip to attach siding boards 30 directly onto the building surface without the shaped insulation board. The front prong 44, the horizontal element 42 and the hind prong 46 of the clip form a U-shaped fork 50 into which a siding board 50 is attached. The width of the fork is defined by the horizontal portion 42 and is such that an upper edge of the siding board 30*b* snugly fits into the fork. The siding board in this case is inserted into the fork so that the front face of the siding board faces 30*c* the front prong 46 of the clip. The back face of the fiber cement board 30*d* faces the hind prong 44 of the clip. The vertical portion 48 of the clip is aligned on the surface of the stud 10. The siding board 30 is attached to the building surface by nailing or screwing through the attachment holes 65 on the clip. A nail or screw 60 is attached through the front prong 46, the siding board 30 and the hind prong 44 to the stud 10. According to one embodiment a bolt may be used to secure the screw attachment. The clip is further attached from the vertical portion 48 with at least one nail, screw or equivalent 60 to the stud 10. Again a bolt may also be used to secure the screw attachment. According to a preferred embodiment the vertical portion 48 is about the same length as the front prong 46. In this embodiment the vertical portion 48 does not necessarily function as a flashing element but a separate flashing element may be attached behind the siding boards to cover the seam between two horizontally abutting siding boards.

FIG. 1 B also shows an embodiment where the lower end of the front prong 30*b* is attached to a snap-away lip 70. Such snap-away lip may be made of stainless steel or galvanized metal, of aluminum, of plastic or other material and its purpose is to aid aligning the boards. Once the boards are attached the snap-away lip may be removed. In FIG. 1B the snap-away lip is a simple horizontal lip. However, the lip may extend further upward to form a U-shape lip where the lower end of the fiber cement board 30*b* fits in.

Referring now to FIG. 2A-H, another embodiments of the invention are shown. According to this invention, the clip may be a welded z-piece as is shown in FIG. 2A, a U-shaped clip as is shown in FIG. 2B, an extended U-shape clip as is shown in FIG. 2C, a 90 degree's Z-shape clip as is shown in FIG. 2C. The clip may be formed of two parts that are welded together as is show in FIG. 2D. The clip may be a 45 degree's Z-shape clip as is shown in FIG. 2E. The clip may be a double layer h-shape clip with inside hem in the hind prong as is shown in FIG. 2F or a double layer h-shape clip with outside hem in the vertical portion as is shown in FIG. 2G. Finally, the clip may be made of two parts, where first part contains the front prong, the horizontal portion, and the vertical portion and the second part contains the hind prong and vertical portion. The vertical portions of the first part and the second part are welded. In the embodiments illustrated in FIGS. 2 A-C and 2G-H the crucial feature is that a siding board can be inserted in a fork. In all of the embodiments the siding board is attached to the building surface by nailing or screwing through at least a front prong and the siding board or through or the front prong, a hind prong and the siding board. Where the clip has a vertical portion it is also attached to the building surface by nailing or screwing through the vertical portion.

Referring now to FIG. 3 a preferred embodiment of the clip is shown. The clip 40 has a front prong 46, a horizontal portion 42 connecting the front prong 46 and the hind prong 44, and a vertical prong 48 extending from the hind prong. A siding board 30 is inserted into the fork 50 formed by the two prongs and the horizontal portion. Depending on whether there is a shaped insulating foam board between the building surface and the siding board the siding board is inserted into the fork either front face toward the hind prong (when there is shaped foam board) or front face toward the front prong (when there is no shaped foam board). In case where shaped foam board with a vertical flat groove as a stud marking is used, the siding board may be inserted into the fork with front face toward the front prong and the clip is to locate within the flat groove.

FIGS. 4 A and B shows the clip 40 can on a siding board. FIG. 4A shows how the length of the horizontal portion equals with the thickness of the siding board so that the board snugly fits into the fork. The figure also shows how there are attachment holes 65 in the front prong 46, hind prong 44 to nail or screw the siding board on a stud and there are attachment holes 65 also in the vertical portion to nail or screw the clip more securely to the stud. FIG. 4 B shows a back view of the clip.

FIG. 5 shows how the vertical portion of the clip 48 forms a flashing covering a seam between two abutting siding boards 80. In this embodiment the vertical portion has a length that is substantially same as the width of a long face of a ridge in the shaped insulation board. The clip remains invisible under the two vertically overlapping siding boards because the length of the front prong and the hind prong are not larger than the overlapping portion of the siding boards.

Referring now to FIG. 6A-B, according to one preferred embodiment the hind prong 44 of the clip is substantially of same length as the width of the siding board.

Referring to FIG. 6C, according to one preferred embodiment the clip has a U-shape and is substantially the same length as a siding board 30 and thereby can be used for one board or it can be used for covering the back of half a length of one board and half a length of an adjacent board as is shown in FIG. 6C.

Referring now to FIGS. 7 A, B and C one preferred embodiment of this invention is a clip with a cutout hook. In FIG. 7A the hook is in an open position, and the siding board is in between the clip prongs. In FIG. 7B the hook 90 has been pushed in, whereby the hook goes through the siding board and attached the board on the wall structure behind the clip. FIG. 7C shows a front perspective view of the clip with the cutout hook in open position. The hook is cut out from the clip leaving an opening 100 in the clip. Once the hook is pushed closed it goes through the opening and penetrates through the siding board and attaches it on the wall structure. The form of the clip is shown as H-shaped clip, but other clip designs described in this application may also be used with the cutout hook.

According to a preferred embodiment the clips described in this application are used to mount building siding boards, such as but not limited to fiber cement boards. However, the clips may be also used in mounting trim boards.

The clip is may be made of metal, stainless steel, galvanized metal, high density plastic or aluminum, but other materials may also be used. The clip may be coated or otherwise treated. The width of the clip may be chose and required but the preferable width of the clip is between 2 and 8", more preferably between 3 and 6" and most preferably the width of the clip is 3". According to one preferred embodiment the combined length of the hind prong and the vertical portion is same as the width of the siding board. Preferably the combined length is between 7 and 8". The length of the hind prong and the front prong is preferably about the same as the overlap of two vertically abutting siding boards. Preferably the length of the hind and front prongs is between 1 and 3", more preferably between 1 and 2" and most preferably 1.25".

According to one preferred embodiment the clip may have a horizontally protruding snap-away lip either on the lower end of the prong that is facing the front side of the fiber cement board. This is shown schematically in FIG. 1B (element 70). If the front side of the board is facing the front prong the lip is on the lower end of the front prong, if the front side of the board is facing the hind prong, the lip is on the lower end of the hind prong. The lip may be made of metal, stainless steel, galvanized steel, high density plastic, plastic or aluminum. The purpose of the lip is to help aligning the siding board above the clip. The lip is preferably a clip-away lip that can be easily taken off after the siding board is attached to the building side. According to one preferred embodiment the lip may have horizontal portion that has a depth substantially same as the thickness of the siding board, and a vertically protruding secondary lip that helps holding the lower end of the siding board while it is attached to the building side.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A siding installation system comprising:

at least one shaped insulation board having at least one ridge thereon, wherein the at least one shaped insulation board is configured to receive at least one siding board on a portion of a front face formed by the at least one ridge;

a plurality of universal clips configured to be coupled to said at least one shaped insulation board and said at least one siding board, each of said universal clips comprising, a hind prong being substantially rectangular in shape and having a lower end, an upper end, and at last one attachment hole;

a front prong being substantially rectangular in shape and having a lower end, an upper end, and at least one attachment hole;

said hind prong and front prong having substantially same lengths;

a horizontal portion having a front end and a back end, said front end being connected to the upper end of the front prong in a substantially rectangular angle, and said back end being connected to the upper end of the hind prong in a substantially rectangular angle;

said horizontal portion having a width substantially equal to a thickness of the at least one siding board;

said front prong, hind prong and horizontal portion forming a U-shaped fork where an upper end of the siding board snugly fits; and a vertical portion being substantially rectangular and having a lower end, an upper end, and at least one attachment hole, said vertical portion continuing seamlessly upward from the upper end of the hind prong; whereby when installed, the front prong is configured to directly abut the front face of the insulation board.

2. The system of claim 1, wherein the length of the hind prong is substantially same as an overlap of two of the siding boards installed vertically adjacent to each other.

3. The system of claim 1, wherein a length of the vertical portion is substantially same as a width of a long face of the ridge of the shaped foam insulation board.

4. The system of claim 1, wherein a snap-away lip is attached to the lower end of the front prong or the lower end of the hind prong.

5. The system of claim 1, wherein the clip is made of one piece, and the hind prong has an inner layer and an outer layer and the outer layer extends to the vertical portion.

6. The system of claim 1, wherein the clip is made of one piece, and the vertical portion has an inner layer and an outer layer and the outer layer extends to the hind prong.

7. The system of claim 1, wherein the clip has a width substantially the same as the length of the siding board.

8. The system of claim 1, wherein the clip is made of a first and a second piece, and the first piece consists of the front prong and the horizontal portion and the second piece consists of the vertical portion and the hind prong, and the first piece is welded to the second piece at a point where the horizontal piece attaches the hind prong.

9. The system of claim 1, wherein the clip is made of a first and a second piece, and the vertical part has two layers and the first piece consists of the front prong, the horizontal portion and an inner layer of the vertical part, and the second piece consists of an outer layer of the vertical part and the hind prong, and wherein the inner and outer layers of the vertical part are welded together from at least one point.

* * * * *